US009156173B2

(12) United States Patent
Fuerst et al.

(10) Patent No.: US 9,156,173 B2
(45) Date of Patent: Oct. 13, 2015

(54) CUTTING DEVICE FOR CUTTING HAIR

(75) Inventors: Stefan Fuerst, Kronberg (DE); Oliver Von Sartori-Montecroce, Kronberg (DE)

(73) Assignee: Braun GmbH, Kronberg (DE)

( * ) Notice: Subject to any disclaimer, the term of this patent is extended or adjusted under 35 U.S.C. 154(b) by 550 days.

(21) Appl. No.: 12/599,760

(22) PCT Filed: May 2, 2008

(86) PCT No.: PCT/EP2008/003545
§ 371 (c)(1),
(2), (4) Date: Oct. 13, 2010

(87) PCT Pub. No.: WO2008/141720
PCT Pub. Date: Nov. 27, 2008

(65) Prior Publication Data

US 2011/0016727 A1 Jan. 27, 2011

(30) Foreign Application Priority Data

May 18, 2007 (DE) ..... 10 2007 023 362

(51) Int. Cl.
*B26B 19/06* (2006.01)
*B26B 19/10* (2006.01)

(52) U.S. Cl.
CPC ..... *B26B 19/06* (2013.01); *B26B 19/10* (2013.01)

(58) Field of Classification Search
USPC ..... 30/34.1, 43, 43.92, 210, 216, 233.5
See application file for complete search history.

(56) References Cited

U.S. PATENT DOCUMENTS 1,596,241 A * 8/1926 Donnellon ..... 30/223
2,152,815 A * 4/1939 Muros ..... 30/43.92
2,370,544 A * 2/1945 Jepson et al. ..... 30/34.1
2,630,628 A * 3/1953 Hall ..... 30/216
3,100,342 A * 8/1963 Konig ..... 30/200

(Continued)

FOREIGN PATENT DOCUMENTS

DE 26 46 818 * 5/1977
DE 2646818 A 5/1977

(Continued)

OTHER PUBLICATIONS

PCT International Search Report dated Jul. 24, 2008.

*Primary Examiner* — Hwei C Payer
(74) *Attorney, Agent, or Firm* — Jay Krebs

(57) ABSTRACT

The invention relates to a cutting device (1) for cutting hair, having at least two blades (2, 3) which move back and forth relative to each other. The blades (2, 3) are provided with teeth (8, 9) which extend transversally to the direction of movement (P), and tooth gaps (25, 26) arranged therein. The teeth (8, 9) have contact surfaces (4, 5) on their facing sections which are in gliding contact with each other and which form cutting edges (34, 35) on their sides bounding the tooth gaps (25, 26) such that the back and forth movement (P) of the blades causes the tooth gaps (25, 26), cooperating with each other, to form constantly changing cutting gaps (32) in which hair becomes clamped and is finally cut. According to the invention, the free ends of teeth (9) of one blade (3) project over sections (15) of free ends of teeth (9) of other blades (2), and projections (17) extend from the projecting sections (15) of the teeth (9) on the contact surfaces (5) side. The projections (17) improve the cutting result by erecting the hairs lying flat against the skin surface (29) during the cutting process, feeding them more easily to the teeth (8, 9).

6 Claims, 2 Drawing Sheets

(56) References Cited

U.S. PATENT DOCUMENTS

Figure 1:
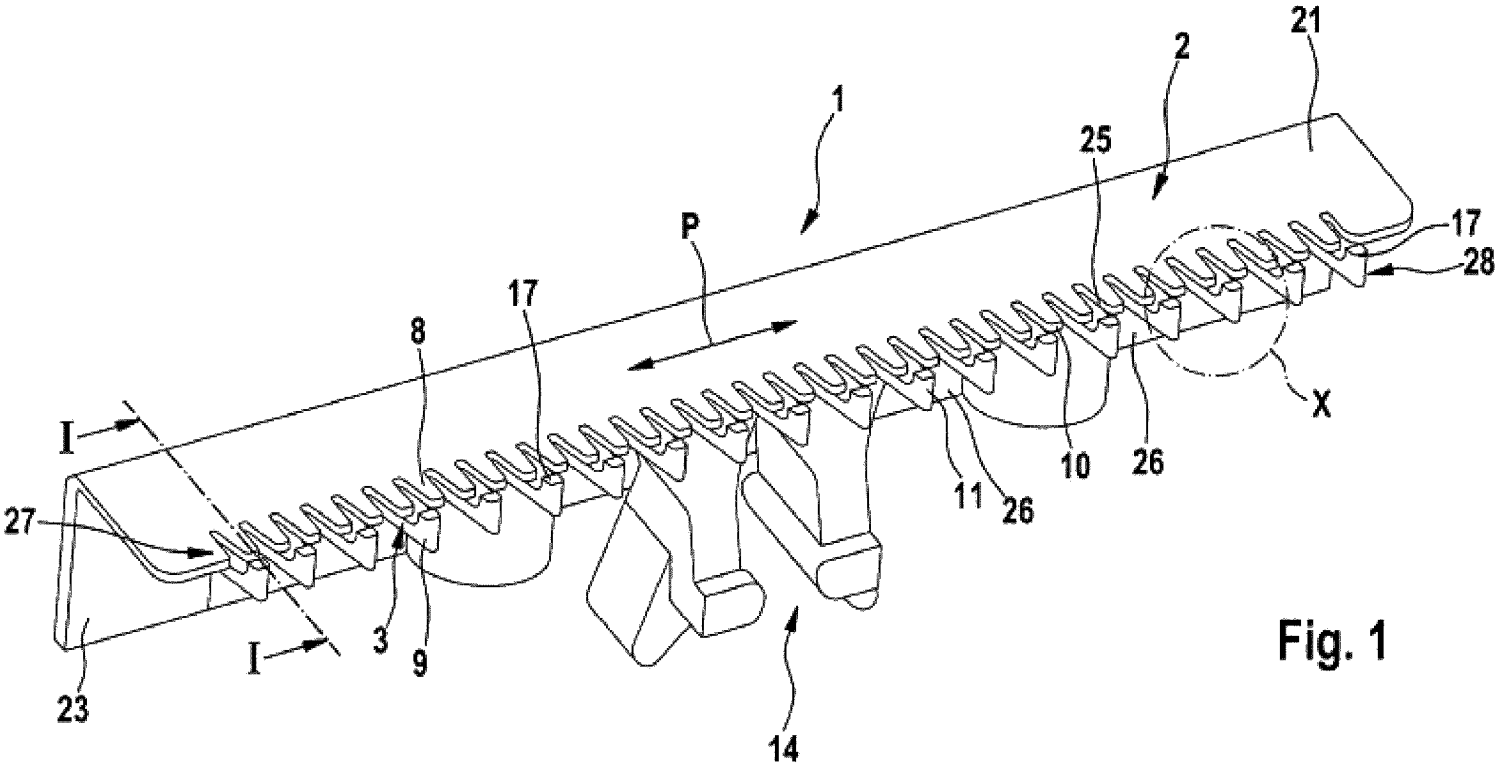

| | | | | |
|---|---|---|---|---|
| 4,512,077 | A * | 4/1985 | Tanabe et al. | 30/43 |
| 4,803,780 | A * | 2/1989 | Locke et al. | 30/34.1 |
| 6,082,004 | A * | 7/2000 | Hotani | 30/43.92 |
| 6,141,878 | A * | 11/2000 | Eslambolchi et al. | 30/216 |
| 6,405,439 | B1 * | 6/2002 | Malobabic et al. | 30/43.92 |
| 6,421,922 | B2 * | 7/2002 | Beutel et al. | 30/216 |
| 7,340,839 | B2 * | 3/2008 | Oh | 30/210 |
| 7,415,768 | B2 | 8/2008 | Bader et al. | |
| 8,136,250 | B2 * | 3/2012 | Floessholzer | 30/43.92 |
| 8,141,254 | B2 * | 3/2012 | Shimizu | 30/43 |
| 2006/0207100 | A1 | 9/2006 | Shimizu | |
| 2007/0193034 | A1 | 8/2007 | Oh | |
| 2010/0299937 | A1 * | 12/2010 | Geiser et al. | 30/233.5 |
| 2011/0016727 | A1 * | 1/2011 | Fuerst et al. | 30/208 |
| 2011/0167639 | A1 * | 7/2011 | Lau | 30/34.1 |

FOREIGN PATENT DOCUMENTS

| | | | |
|---|---|---|---|
| DE | 103 44 566 | A1 * | 5/2005 |
| DE | 10 2005 002 895 | A1 * | 7/2006 |
| DE | 102005002895 | A1 | 7/2006 |
| EP | 1140437 | B1 | 3/2003 |
| FR | 1 527 699 | | 6/1968 |

* cited by examiner

CUTTING DEVICE FOR CUTTING HAIR

The invention relates to a cutting device for cutting hair.

Cutting devices of this type are already known from both EP 1 140 437 B1 and DE 26 46 818 A. In these cutting devices, the contact surfaces of the two blades glide relative to each other in such a way that hairs that enter into the tooth gaps of the teeth during the back and forth movement (P) are clamped by the cutting edges that are formed at the transitions of the contact surfaces to the lateral surfaces of the teeth, and subsequently shorn off or cut off. The cutting gaps that are formed by the opposing teeth are constantly widened and narrowed and even closed completely, corresponding to the back and forth movement of the blades, so as to be able to capture and cut the hairs over the entire length of a cutting edge. In both abovementioned cutting devices, the teeth of one cutter are longer than the teeth of the other cutter, such that the comb ends of one cutter project beyond the comb ends of the other cutter to the front.

Furthermore, a shear system is known from DE 103 44566 AI, in which the cutting device consisting of an upper and a lower cutter has a feeding device arranged upstream of the cutting device that is moved back and forth in an oscillatory motion relative to the upper cutter. The feeding device is intended to allow the hair to be removed as thoroughly as possible and with minimum irritation to the user's skin, and also long hairs and/or hairs lying close against the skin to be captured and removed by the shear system with a comparatively high degree of probability. In this embodiment, the feeding device forms an additional unit that is also moved back and forth by the drive unit, and arranged upstream of the actual cutting device.

Lastly, an electric hair cutting device is known from DE 10 2005002895 AI, in which the outer surface of the upper cutter of a center cutting means has raised areas that create the contact to the skin surface of an operator during the shaving process. The raised areas are also intended to capture, and cut by means of the center cutting means, longer hairs lying close against the skin as reliably as possible during the shaving process.

The object of the invention is to create a cutting device, wherein, using particularly simple means, even hairs lying close against the skin can be captured by the teeth in an improved manner, threaded into the tooth gaps and ultimately cut off by the cutting device.

This object is achieved according to the present invention. Because projections are formed on the contact surfaces side on the overlaying sections of the teeth of one blade, these projections are designed in front of or upstream of the teeth of the other blade. During the shaving process, that is during the motion in which the unshaven skin initially comes into contact only with the tips of the longer teeth, the projections result in the hair being better captured, erected, and fed to the cutting gaps more easily, which leads to an improved shaving result. Since the tips of the downstream teeth of the other blade are more protected by the projections, they also are brought into less contact with the skin surface, which results in a shave that is gentler on the skin. According to the invention there is no need for additional components, such as bell cranks or axles, which reduces the amount of work and time involved in the production process.

According to the invention, the edges on the teeth of the other, downstream blade can be designed sharp-edged. Sharp-edged blades in fact improve the erecting and threading-in of the hairs into the cutting gaps, however, it would be more irritating to the skin surface if the downstream tooth tips did not have the projections provided upstream thereof, which is not according to the invention. This, accordingly, results in an improved shaving result while being gentler on the skin.

The blade movement advantageously acts on the outer contour of the toothing and can therefore be straight, arcuate or circular.

According to another embodiment, the blade featuring the projections is energized with the oscillating back and forth movement, which further enhances the threading-in of the hairs into the cutting gap. In this process, the other blade forms the fine-toothed comb, while the blade featuring the projections forms the actual cutter of the cutting device. During the shaving process, the back and forth movement of the projections therefore causes the hair to be erected by the same and fed to the tooth gaps of the other blade, namely the fine-toothed comb, where they are then ultimately aligned, clamped between the teeth and cut off. The projections are rounded off all around, thereby protecting the skin from the sharp edges of the other blade located downstream of the projections, namely the comb. The projections that move on the skin could be utilized via a special design specifically for peeling or loosening the hairs in the hair canals. Studies performed with the embodiment according to the invention have shown that the loosening of the hairs is improved by the projections and, for this reason the closeness of the shave is increased.

According to another embodiment, the projections are formed by raised areas that are designed cone-shaped, pencil-shaped or pillar-shaped in the longitudinal direction thereof, with the outwardly facing sidewall of said raised areas transitioning steplessly into the lateral surfaces of the respective tooth. The sidewall of a projection thus transitions flush in a straight line into the lateral surface of a tooth and together with the respective tooth forms an elongated tip. The cross section of a projection may be designed circular, oval, polygonal or in some other shape, it is only important that during the shaving process the surface of the skin encounters a projection that is rounded toward the tip, so as not to be injured. The cross sections of the projections as well as the tooth tips of the cutter can also become more blunt toward the margins of the blades, so as to effect the greatest possible skin protection. The projections may also be designed in the form of rounded nubs.

According to another embodiment, the lateral surface of a projection, which terminates flush with lateral surface of a tooth, forms a common plane with the lateral surface of the respective tooth. This prevents stepped transitions from the projections to the lateral surfaces of the teeth on the outwardly facing areas, thereby being gentler on the surface of the skin of an operator during the shaving process.

According to another embodiment, the sidewall of a projection tapers toward the free end thereof. This enables a simplified production of the blade, which is preferably produced by means of a punching and stamping technique. In the process, the projections are preferably shaped upward out of the plane of the teeth during the stamping process. The teeth are subsequently punched out, or cut out using a laser beam.

According to another embodiment, the projections are provided at their front faces with outwardly arched end sections. Due to the outwardly rounded free ends of the projections, the skin is thus treated more gently during the shaving process.

According to another embodiment the cutting device according to the invention is used as a trimmer or contour cutter, i.e. the lateral surfaces formed at the tips of the teeth form the gliding surface with respect to the skin surface of an operator. Such trimmers, which are arranged projecting out perpendicularly, are generally fixed on the front side of a shaver housing, such as, for example, in the case of the "Braun Synchro" being sold by the applicant. However, it is also possible, for example, for the trimmer to be folded out perpendicularly from the sidewall of a shaver housing when it is to be used. However, the cutting device according to the invention can also be designed on a device that is used as a beard trimmer.

According to another embodiment, the blade that is not provided with the projections forms the contact surface to the skin surface, i.e. during the shaving process the outer surface of the fine-toothed comb glides along on the skin surface and therefore forms, in this embodiment, the upper cutter, while the blade provided with the projections forms the lower cutter that can preferably be moved back and forth in an oscillating motion. According to another embodiment, the cutting device is arranged upstream or downstream of a short-hair cutting system, i.e. in the one motion the cutting device according to the invention initially captures the longer hairs, whereas the fine cut subsequently takes place by means of the downstream short-hair cutting system (consisting of a perforated foil and reciprocating lower cutter.)

In another embodiment, the cutting device according to the invention forms a center cutting means that is interposed between two short-hair cutting systems. Therefore, the cutting device according to the invention has teeth that extend freely to both sides, wherein the reciprocating blade has, at the end of the teeth, the projection extending upward toward the comb. In this manner, the teeth of the blade that can be brought into contact with the skin are arranged downstream, protected by the projections during the shaving process in both shaving directions. A center cutting means without the subject matter of the invention is known, for example, from the "Braun 3600 Complete" shaver that has been sold by the applicant for some time, or from the "Braun Pulsonic" shaver. In these shaver types the cutting device according to the invention could be used in lieu of the center cutting means that is known there.

Figure 2:
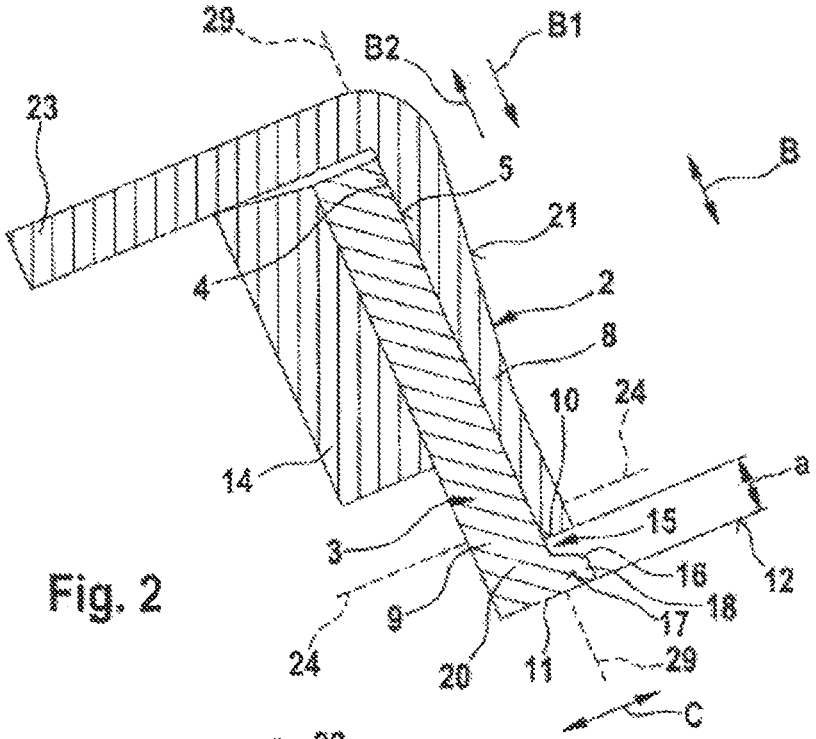
Figure 3:
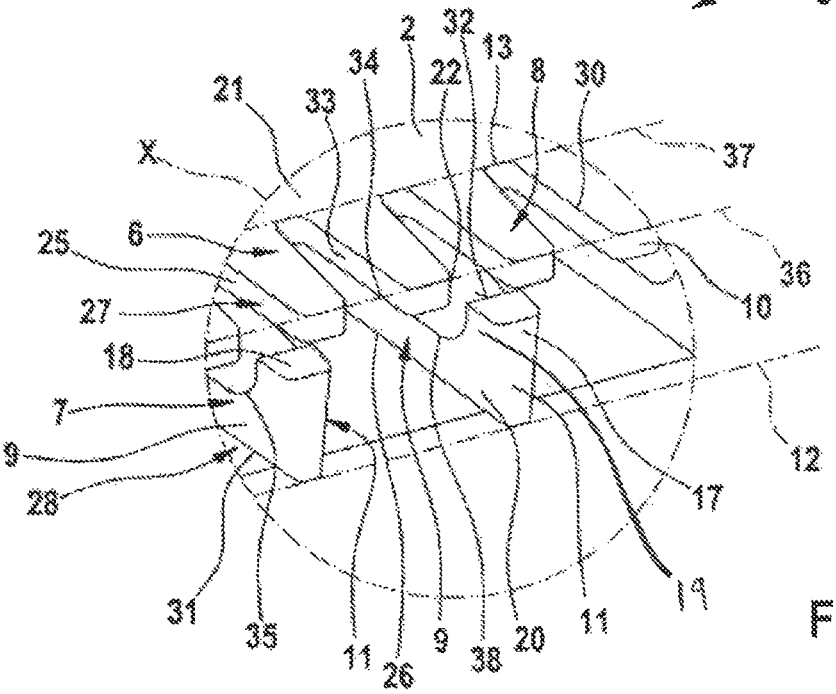

An exemplary embodiment of the invention is shown in the drawing and will be described in more detail below. In the drawings:

FIG. 1 shows a perspective top view from the top right depicting an exemplary embodiment of the cutting device according to the invention on an enlarged scale, FIG. 2 shows a section through the cutting device according to the section line I-I according to FIG. 1 on an even further enlarged scale, FIG. 3 shows a depiction enlarged from FIG. 1 of the section X according to FIG. 1.

In FIGS. 1 to 3, the cutting device 1 consists of an upper blade 2 and a lower blade 3 that are in gliding contact with each other via contact surfaces 4, 5 (FIG. 2) that glide on each other. On the frontal free ends 6, 7 of the upper and lower blade 2, 3, comblike teeth 8, 9 are arranged according to FIGS. 1 and 3 in rows of teeth 27, 28, the tips 10, 11 of which lie on straight lines 36, 12 that extend parallel to each other (indicated here by dot-and-dash lines.) The tooth base 13 of all teeth 8, 9 lies on the straight line 37 (lower line not visible), wherein all lines 36, 12, 37 preferably extend parallel to each other.

The upper blade 2 forms, according to FIGS. 1 to 3 in this exemplary embodiment, the actual comb of the cutting device 1, while the lower blade 3 forms the cutter. Therefore, preferably only the cutter 3 can be moved back and forth in an oscillating motion in the directions P, wherein the movement P preferably extends perpendicular and transversely to the extension of the teeth 8, 9 and parallel to the line 12. In this exemplary embodiment a coupling element 14 that is connectable to a driving element (not shown) of an electric motor (not shown) is arranged either coupled to the cutter 3 or integrated into the same, by means of which the cutter 3 is driven into the back and forth oscillations P. Furthermore, a pressing device not shown in the drawing, preferably one or more springs, is configured in the cutting direction, by means of which the cutter 3 is pressed with its contact surface 5 against the contact surface 4 of the upper cutter 2.

As is furthermore apparent from FIGS. 1 to 3, the teeth 9 of the lower blade 3 extend beyond the teeth 8 of the upper blade 2 toward the front, beyond the section 15. This can be achieved either in such a way that the lower teeth 9 are longer than the upper teeth 8, or in such a way that all the teeth 8, 9 are identical in length but offset from each other by the dimension (a).

From the surface 16 of the cutter 3, a projection 17 extends, according to FIGS. 1 to 3, in each case. In an alternate embodiment (not shown), said surface 16 is preferably level with the contact surface 5. The projections 17 protect the adjacent tips 10 of the teeth 8 of the upper blade 2 when the skin surface 29 is pressed during the shaving process in the direction B2 against the tooth tips 11. The projections 17 are preferably configured pencil-shaped or pillar-shaped and, in an alternate embodiment (not shown), have at their free ends convexly (upwardly) arched end sections 18 in the form of caps that can extend preferably flush with the top surfaces 21 of the tooth tips 10, or slightly above or also below the same. The projections 17 form a peripheral surface 19 over the periphery thereof that transitions without step (FIGS. 2 and 3), namely is straight, into the lateral surfaces 20 of the sections 15, i.e. no steps are created here. Only where the peripheral surface 19 meets the surface 16, a corner 38 is inevitably created; however the same lies protected in the inner region on the teeth 9. A small gap 22 exists between the projections 17 and the tooth tips 10, in order for the blades 2, 3 to be able to move unimpeded relative to each other in this region.

According to FIGS. 1 and 2, the upper blade 2 is angled in the rearward region via the end piece 23 by approximately 900 so as to fix the upper cutter 2 in the shaver housing (not shown).

The cutting device 1 according to FIGS. 1 to 3 can also preferably be used as a trimmer, wherein it then projects preferably from the front side of a shaver housing (not shown) and is moved perpendicularly from the front against the tips 10, 11 to the skin surface 24 to be shaved. The shaving movement is then performed back and forth in direction C.

Because the illustration of the cutting device 1 according to FIGS. 1 to 3 has been depicted greatly enlarged, the penetration depth of the teeth 8, 9 on the skin surface 24 and 29 is also shown greatly enlarged. In the cutting device 1 according to FIGS. 1 to 3, the lower cutter 3 is preferably driven so as to oscillate. It is also possible, however, that only the upper cutter 2 is driven in lieu of the lower cutter 3. It is also conceivable that both blades 2, 3, are moved in an oscillating motion. As a further variant, it is also possible that one of the two blades 2 or 3 is driven, while the other blade is supported oscillating in the housing (not shown) of a shaving apparatus, such that opposite oscillating movements can increase the cutting effectiveness.

The cutting device 1 depicted in FIGS. 1 to 3 may be used, for example, in the "Braun Synchro" shaver which has been sold by the applicant for a long time, in lieu of the trimmer that is provided there, in which case the shaver is then moved in the direction C with the tooth tips 11 on the skin surface 24 (FIG. 2). The cutting device 1 can, however, also be employed as a center cutting means, such as it is used in the "Braun 3600

Complete" shaver sold by the applicant, or the "Braun Pulsonic," in which case the shaver is then moved in the direction B on the skin surface 29 (FIG. 2). In order to cut hair with the center cutting means in both movement directions B1, B2, all that would be required is to provide a second row of teeth (not shown) on the other side on the edge 25, wherein the top surface 21 and no longer the tips 10, 11 then creates the contact to the skin surface. In the latter case, the skin surface 29 (FIG. 2) then extends parallel to the teeth 8, 9 and the end sections 18 of the projections 17 glide on the skin and erect the hairs (not shown) lying against the skin surface 24 via the oscillating movement of the tips 11 and feed them to the tooth gaps 26 of the upper and lower blade 2, 3.

After hairs enter into the cutting gaps 32 that are formed between the teeth 8, 9, they are captured at the cutting edges 34, 35 bounded by the lateral surfaces 33, 20 toward the contact surfaces 4, 5, or by the edges 30, 31, and with the continued narrowing of the cutting gap 32, cut off by the cutting edges 34, 35. Because of the upstream projections 17 the teeth 9 can have particularly sharp lateral edges 30, 31 at the transition from the lateral surfaces 20 to the top surface 21 and to the contact surface 4, which also applies then for the tips 10 of the upper blade 2 as the comb. This results in an improved threading of the hair into the comb, and thus improves the shaving result.

What is claimed is:

1. A cutting device (1) for cutting hair, having at least an upper comb blade (2), a movable lower cutter blade (3), and a coupling element (14) coupled to the lower cutter blade (2) and connectable to a driving blade element of a motor for moving the lower cutter blade (3) back and forth relative to the upper comb blade (3), said blades being provided with teeth (8, 9) which extend transversally to the direction of movement (P) of the lower cutter blade (3), and tooth gaps (25, 26) arranged therein, wherein the teeth (8) of the upper comb blade and the teeth (9) of the lower cutter blade (3) have contact surfaces (4, 5) on their facing sections which are in gliding contact with each other and which, in turn, form cutting edges (34, 35) toward lateral surfaces (33, 20) bounding the tooth gaps (25, 26), such that the back and forth movement (P) of the lower cutter blade (3) causes the tooth gaps (25, 26), cooperating with each other, to form constantly changing cutting gaps (32) in which hair becomes clamped and is subsequently cut, characterized in that projections (17) of the teeth (9) of the lower cutter blade (3) project from the contact surface (5) of the lower cutter blade (3) away from said coupling element (14) beyond the tooth tips (10) of the teeth (8) of the upper comb blade (2), wherein the projections (17) project in an upward direction away from the coupling element (14).

2. The cutting device according to claim 1, characterized in that the projections (17) are designed pillar-shaped or cone-shaped.

3. The cutting device according to claim 1, wherein the teeth (9) of the lower cutter blade (3) each have a tooth tip (11), characterized in that a peripheral surface (19) of each of the projections (17) tapers, starting from the associated tooth (9), toward the tooth tip (11).

4. The cutting device according to claim 1, characterized in that the projections (17) are provided on their front faces with outwardly arched end sections (18).

5. The cutting device according to claim 1, characterized in that the lateral surfaces (20) on tooth tips (11) of the teeth (9) of the lower cutter blade (3) form a gliding surface for a skin surface (24) of an operator.

6. The cutting device of claim 1, wherein said teeth (8) of the upper comb (2) blade comprises sharp edged blades.

* * * * *